United States Patent [19]

Reed

[11] Patent Number: 5,000,719

[45] Date of Patent: Mar. 19, 1991

[54] RETRIEVABLE SEALING PLUG AND METHOD OF MAKING SAME

[76] Inventor: Lehman T. Reed, 3219 Candlewood Dr., Bakersfield, Calif. 93306-1617

[21] Appl. No.: 460,533

[22] Filed: Jan. 3, 1990

[51] Int. Cl.[5] ..... E21B 33/03

[52] U.S. Cl. ..... 166/88; 166/378

[58] Field of Search ..... 166/88, 75.1, 76, 79, 166/82, 377, 378, 379

[56] References Cited

U.S. PATENT DOCUMENTS

| | | | |
|---|---|---|---|
| 3,299,958 | 1/1967 | Todd | 166/89 |
| 4,444,401 | 4/1984 | Roche et al. | 166/88 |
| 4,627,489 | 12/1986 | Reed | 166/65.1 |
| 4,804,045 | 2/1989 | Reed | 166/65.1 |

*Primary Examiner*—Ramon S. Britts
*Assistant Examiner*—Terry Lee Melius
*Attorney, Agent, or Firm*—John H. Crowe

[57] ABSTRACT

A removable sealing plug for the bore of a high pressure oil or gas well incorporating at least one expandable sealing ring mounted on at least one plug part so as to be frictionally engageable with the surface of the bore and a rotatable plug part screw-threaded in the bore and having a coupling device to the sealing ring mounting designed to prevent rotation of the sealing ring and consequent damage to the bore surface or the sealing ring when the rotatable plug part is screwed into or out of the bore for sealing plug installation or removal purposes.

7 Claims, 3 Drawing Sheets

RETRIEVABLE SEALING PLUG AND METHOD OF MAKING SAME

BACKGROUND OF THE INVENTION

1. Field of the Invention

This invention relates to oil and gas well equipment and has particular reference to a sealing plug for a wellhead and method of making the same.

2. Description of the Prior Art

In the operation of an oil or gas well, an arrangement of valves, termed a Christmas Tree, is usually supported on the wellhead to facilitate remedial and maintenance work on the well. Such valve trees are expensive and complicated and they, themselves, must be serviced occasionally.

In my U.S. Pat. No. 4,804,045, issued on Feb. 14, 1989, I have disclosed and claimed a diversionary spool assembly which is intended to be incorporated in a wellhead and which enables the valve tree to be removed from the wellhead when the tree is not being used. Thus, a single valve tree can be used to service a number of wells, thus obviating the cost of providing a valve tree for each well. The diversionary spool assembly includes a head bore which is normally sealed by a removable plug to permit access through the bore to the interior of the well. Since relatively high pressures, sometimes in the order of 20,000 psi, are generally encountered in such well the plug must be securely sealed in the head bore and yet must be readily removable therefrom.

Accordingly, the plug must be firmly seated, preferably against a shoulder, in the bore. In most cases the plug is composed of two parts with a seal located between the two, in which case one part must be forced toward the other to expand the seal into intimate contact with the bore. In the seating and sealing of the plug, it is desirable that the plug and seal not rotate. Where a metal seal is used, rotation of the seal during expansion thereof into sealing condition can cause abrasion or scoring of both the seal and bore giving rise to the formation of minute scratches through which fluid can leak. Where pliable (plastic or composition) seals of the chevron type are used, rotation of the seal during expansion into sealing condition can damage the seal beyond its ability to effect proper sealing. Where plastic or rubber O-ring seals are used, considerable care must be exercised in inserting the plug into the bore since any rotation of the seal while compressed in sealing engagement with the inner surface of the bore can likewise cause considerable wear on, and damage to, the seal.

I obviated the above-noted problems in the diversionary spool assembly of my aforementioned patent by providing camming screws that are threaded through the wall of the wellhead. Such screws are thus accessible from the exterior of the wellhead to cam the plug against its seat and to cause expansion of the seal against the bore surface. Although such camming screws are fairly satisfactory, it is possible for fluid under high pressure to leak past the screw threads. Also, separate means must be provided to remove the plug from the well.

SUMMARY OF THE INVENTION

A principal object of the present invention is to provide means to overcome the above-noted problem.

Another object is to provide an arrangement for seating and sealing a plug of the above-noted type while obviating the possibility of fluid leakage from the wellhead.

Still another object is to prevent any tendency for such a plug to rotate during the process of seating and sealing the same in the wellhead bore.

A further object is to provide a novel method of making a sealing plug of the above-described type.

BRIEF DESCRIPTION OF THE DRAWINGS

The manner in which the above and other objects are accomplished will be readily understood by reference to the following specification when read in conjunction with the accompanying drawings, wherein.

DESCRIPTION OF THE PREFERRED EMBODIMENTS

Figure 1:
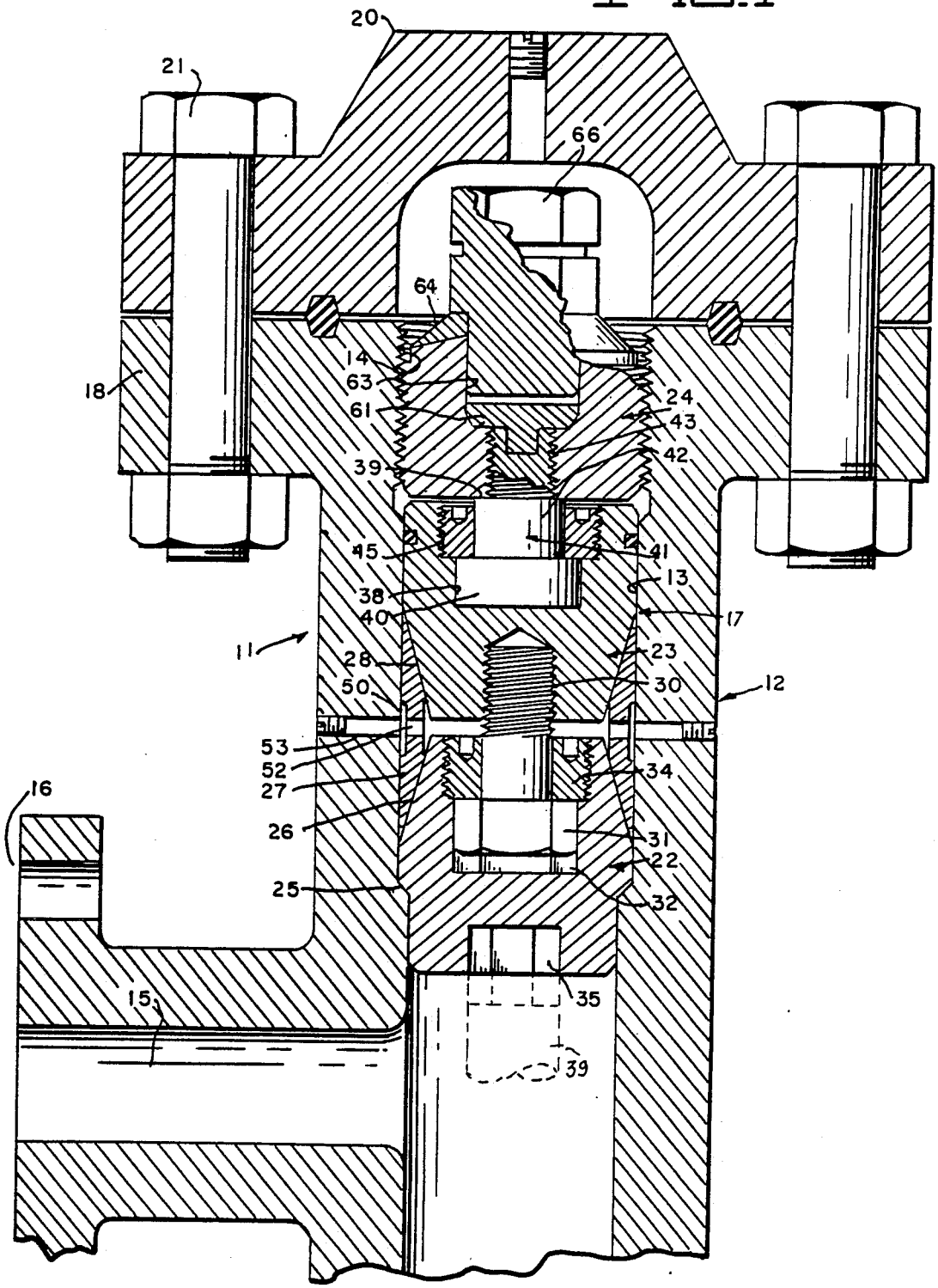
FIG. 1 is a vertical cross-sectional view of a diversionary spool assembly forming part of a wellhead and incorporating therein a sealing plug comprising a metal-to-metal seal for use especially in connection with extremely high fluid pressures or where an external fire may occur.

While the present invention is susceptible to embodiment in many different forms, there are shown in the drawings and will be described in detail certain specific embodiments, with the understanding that the present disclosure is to be considered as an exemplification of the principles of the invention and is not intended to limit the invention to the particular embodiments illustrated.

Although the invention is particularly applicable to a diversionary spool assembly of the type disclosed in my aforementioned patent, it is equally applicable to other forms of well equipment where high fluid pressures are encountered. For this reason, the term "wellhead" as used herein is intended to represent any body associated with a well and having a bore therein through which fluid can be conveyed under pressure.

Figure 2:
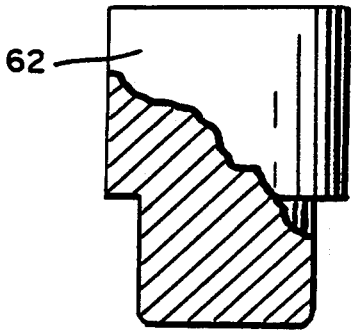
FIG. 2 is a view, partly in section, of a cap for the plug, showing the same prior to assembly in the upper part of the plug.
Figure 3:
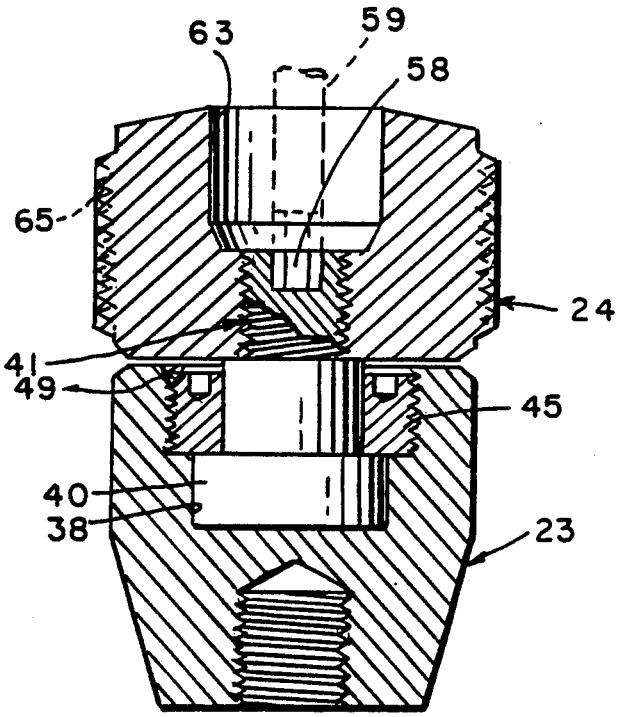
FIG. 3 is a cross-sectional view showing the upper and intermediate parts of the sealing plug in an intermediate stage of construction.

Referring to FIG. 1 through 3, a diversionary spool assembly is generally indicated there at 11 and comprises a wellhead 12 having a bore 13 terminating at its upper end in a screw threaded section 14. The bore communicates through a passage 15 to a flanged outlet 16 adapted to be connected to a suitable valve (not shown) for controlling the outlet of the well. Fluid under pressure is admitted into the lower end of the bore 13 from the well and is normally prevented from passing into the upper end thereof by a sealing plug generally indicated at 17.

The upper end of the wellhead 12 terminates in a flange 18 to which a bonnet 20 is removably secured by bolts 21. When it is required to service the well, the bolts 21 and bonnet are removed along with the plug 17, to be described presently, and a Christmas Tree valve arrangement (not shown) is bolted to the flange 18 in communication with the bore 13.

The plug 17 comprises a lower part generally indicated at 22, an intermediate part 23 and an upper part 24, both loosely fitted in the bore 13. The lower part 22 has a shoulder 25 which seats against a mating shoulder formed in the bore 13 and has an upwardly tapered surface 26 fitting against a mating surface of an annular metal sealing ring 27. The intermediate plug part 23 has a downwardly tapered surface 28 fitting against a mating surface of the sealing ring. Thus, forcing the two plug parts 22 and 23 toward each other causes the ring 27 to expand slightly into sealing engagement with the surface of the bore 13.

The plug parts 22 and 23 are normally held in assembled condition by a connecting bolt 30 having a hexagonal head 31 which slidably fits in a mating hexagonal socket 32 in the part 22. The bolt is threaded into the part 23 and the bolt head is retained in the recess 32 by an annular retainer nut 34 which is slidably fitted over the body of the bolt and is screw threaded in the upper portion of the recess 32.

A hexagonal socket 35 is formed in the lower end of the plug part 22 whereby a suitable tool, such as an Allen wrench, partially indicated by dotted lines 39, may be used to rotate the plug part 22 relative to the part 23 and thus bring the parts 22 and 23 into intimate contact with the sealing ring 27.

An annular channel 50 is formed around the central portion of the sealing ring 27 and communicates with small openings 52 extending through the ring. The channel also communicates with normally closed passages 53 in the wall of the wellhead 12 so that after the ring 27 has been set in sealing condition, a suitable fluid sealant may be injected through the passages 53 into and around the ring and thereafter allowed to set to enhance the sealing effect of the ring. Means are provided to form a swivelling connection between the upper plug part 24 and plug part 23. For this purpose, a recess 38 is formed in part 23 to rotatably receive the cylindrical head 40 of a swivel bolt 41 having a smooth shank diameter section 42 and a reduced diameter threaded section 43 threaded into the upper part 24 and permanently attached thereto by welding as indicated at 61.

The head 40 of bolt 41 is retained in recess 38 by an annular retainer nut 45 which is threaded into an enlarged portion of recess 38 and lightly bears against the upper or rear surface of the head 40.

It will be noted that the shank 42 of bolt 41 is somewhat longer than the length of the nut 45 so that the part 24 bears only against the shoulder 39 between the shank 42 and the threaded section 43 of the bolt.

In fitting the plug 17 in the bore 13, its parts 22 and 23 are first drawn together by rotating the part 22 relative to part 23 until the sealing ring 27 forms a frictional fit in the bore. The plug is then pressed into the bore to engage the upper part 24 with the threaded bore section 14. Thereafter, the upper part is rotated by means of a suitable tool, such as a wrench, to drive the plug downwardly to seat against the shoulder 25 and then further force the part 23 downwardly, causing the sealing ring 27 to expand into tight-sealing engagement with the surface of the bore.

Since the outer frictional area presented by the sealing ring 27 is greater than the lower frictional area presented by the swivel bolt head 40, the bolt will not transmit rotation to the plug part 23 during downward movement of the same and therefore only tightening of ring 27 against the bore wall will result. This will obviate any tendency of the ring to scratch or score the surface of the bore. Any scoring due to axial movement of the sealing ring because of this tightening effect has been found to to insignificant.

Likewise, the frictional area formed between bolt head 40 and the bottom of the retaining nut 45 is less than the frictional area of sealing ring 27 so that during withdrawal of the plug by the unscrewing of part 24 there will be no tendency for the sealing ring to rotate.

As depicted in FIG. 2 and 3, plug part 23 and head part 24 are assembled by forming a hexagonal socket 58 in the upper end of bolt 41. The bolt head 40 is then fitted into the recess 38 and retainer nut 45 then screwed into place. The retainer nut can be locked in place by slightly deforming the mating threads of the nut and part 23 as indicated at 49, using a center punch or the like (not shown). Thereafter, by using a suitable tool, such as an Allen wrench (partially shown in dotted lines 59), and suitably holding the head part 24, the parts are secured tightly together and permanently attached by welding, as indicated at 61 (FIG. 1). Then a cylindrical plug cap member 62 is fitted in a recess 63 in the plug part 24 and permanently secured there by welding as indicated at 64 (in FIG. 1).

Finally, screw threads indicated by dotted lines 65 are formed on part 24 and a hexagonal formation 66 (FIG. 1) is machined on the plug cap 62 to enable a suitable tool to be used to screw the part 24 into and out of the threaded bore section 14 to insert or withdraw the plug.

FIRST MODIFIED EMBODIMENT

Figure 4:
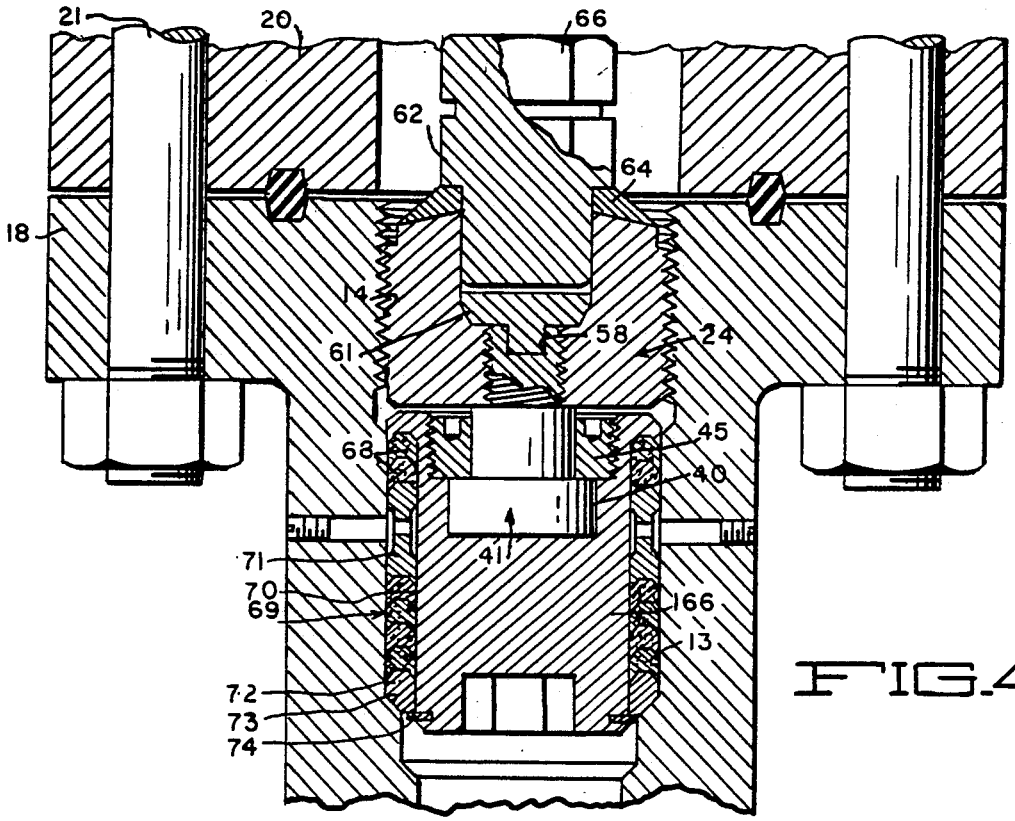
FIG. 4 is a vertical cross-sectional view showing the sealing plug mounted in a diversionary spool assembly similar to that shown in FIG. 1, but incorporating chevron type seals for use, especially where high temperature conditions are encountered such as in geothermal or steam-injection wells.

FIG. 4 illustrates a modified form of the invention utilizing a chevron type seal generaly indicated at 69. Parts similar to parts depicted in FIG. 1 to 3 are here identified by the same numerals as there.

Seal 69 comprises two sets of flexible annular rubber or composition sealing rings 68 which are substantially U-shaped in cross section and are fitted in an annular groove 70 formed in a plug part 166. The latter is rotatably connected to plug part 24 in the same manner as is part 23 of FIG. 1. The sets of rings 68 are separated by an annular metal spacer ring 71 and the lowermost ring 68 overlies an annular metal ring 72 which seats against a shoulder 73 formed in bore 13.

Sealing rings 68 are normally held in a slightly compressed and thus slightly expanded condition between the upper end of groove 70 and ring 72 by a snap ring 74 on part 166 so that when the plug is inserted in the upper end of the bore 13 they frictionally engage the surface of the bore. Thus, when the upper plug part 24 is screwed into the threaded bore section 14 the frictional engagement of the sealing rings 68 with the bore surface will resist turning and as the part 24 is further driven downward, the sealing rings will be compressed further to expand outwardly into sealing engagement without any tendency to rotate, thus obviating the possibility of damage to or destruction of the seals. When the plug is to be removed from the bore, the part 24 is unscrewed from the threaded bore section 14. This will relieve the major compression of the sealing rings but due to their prestressed condition, the rings will still exert sufficient frictional engagement to resist rotational movement of part 166 and rings 68.

SECOND MODIFIED EMBODIMENT

Figure 5:
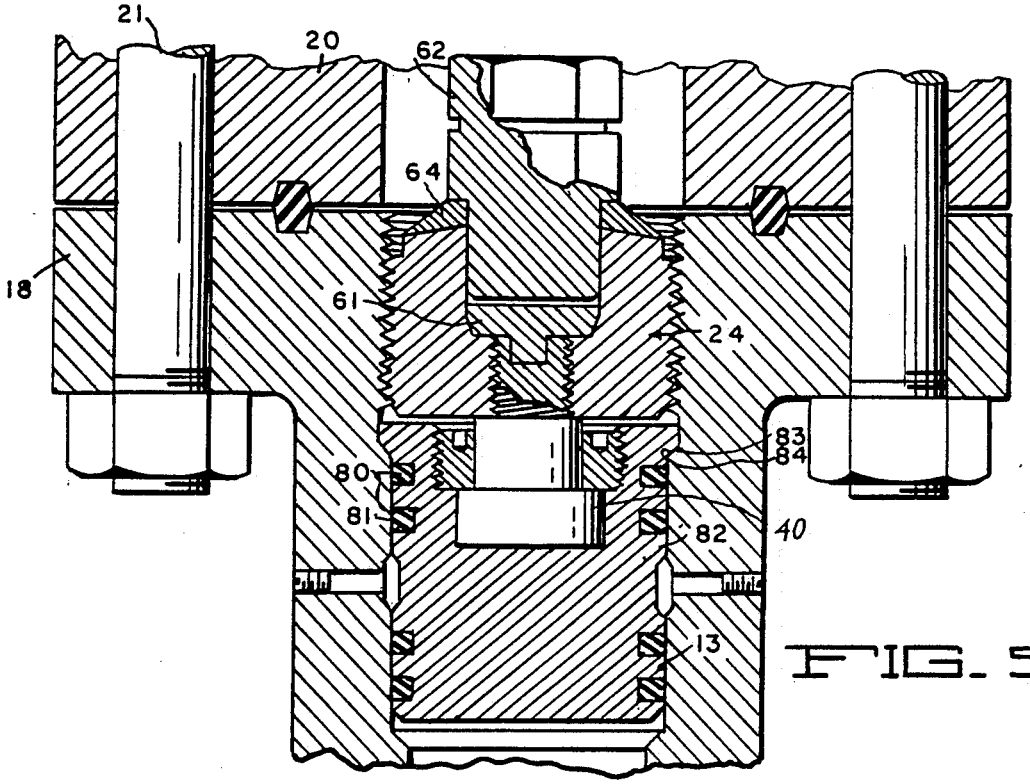
FIG. 5 is a vertical cross-sectional view showing the sealing plug mounted in a diversionary spool assembly, similar to that of FIG. 1, but incorporating O-ring type seals for general use where extremes in temperature and fluid pressure are not encountered.

FIG. 5 illustrates another modified form of the invention utilizing an O-ring seal arrangement. Here again parts like those shown in FIG. 1 to 3 are identified by like reference numerals.

Rubber or flexible plastic O-rings 80 are fitted in annular grooves 81 formed in a lower plug part 82. The latter, which is slidably fitted in the bore 13, is rotatably connected to the part 24 in the same manner as is part 23 in FIG. 1.

Each of the O-rings 80 has a normal outside diameter which is slightly greater than the diameter of bore 13 so that when the plug is inserted in the bore, the rings will frictionally engage the surface of the bore. Here, the frictional engagement of the O-rings with the surface of the bore 13 is greater than the frictional engagement of the bolt head 40. Thus, when the plug part 24 is screwed into the bore, the O-rings will prevent rotation of the part 82. As the plug part 24 moves into place a shoulder 83 on part 82 seats against a mating shoulder 84 in the bore.

Whenever the plug part 24 is unscrewed to remove the plug, the O-rings will likewise frictionally engage the bore surface sufficiently to prevent turning of the O-rings and part 82 during withdrawal of the plug. However, the O-rings will not appreciably resist axial movement of the plug.

From the foregoing, it will be seen that I have provided a novel retrievable high pressure sealing plug having one or more sealing rings in which the plug can be screwed into or out of the upper open end of a well bore without rotating the sealing rings which could otherwise scratch the surface of the bore or destroy the sealing capability of the sealing rings, depending upon the type and material of construction of the sealing ring or rings.

I claim:

1. A sealing plug for the bore of a wellhead which has a screw-threaded section therein, comprising:

a first plug part movable in said bore;

sealing means carried by said part and frictionally engaging the surface of said bore;

a second plug part threadedly engageable with said screw-threaded section;

a swivel connection between the two plug parts comprising a connecting element extending from one of said parts, said connecting element having a swivel head thereon with a front face distal, and a rear face proximal, to said one of said parts, said front face of said head being rotatably engageable with an abutting surface on the other of said parts; and a retainer element supported by said other of said parts positioned for rotatably engaging the rear face of said head;

the frictional drag on either the front face of said swivel head by said abutting surface or the rear face thereof by said retainer element being less than the frictional drag on said sealing means by said surface of said bore whereby rotation of said second plug part will not cause rotation of said first plug part.

2. A sealing plug as defined in claim 1 wherein said connecting element extends from said second part.

3. A sealing plug as defined in claim 1 including a recess in said other of said parts for receiving said head;

said retainer element being secured in said recess and surrounding said connecting element.

4. A sealing plug as defined in claim 1 including a tool receiving formation on the end of said second plug part opposite said connecting element for enabling rotation of said second plug part.

5. A sealing plug as defined in claim 1 wherein said first plug part comprises a pair of plug elements movable axially relative to each other; and said sealing means comprises a sealing ring intermediate said plug elements and expandable by said plug elements upon axial movement of one of said plug elements relative to the other; and means in said bore for arresting axial movement of one of said plug elements.

6. A sealing plug as defined in claim 5 wherein said plug elements have facing and inwardly tapering end portions engageable with said sealing ring for expanding said ring upon said axial movement of one of said plug elements toward the other.

7. A sealing plug for the bore of a wellhead, which bore has a screw-threaded section therein, comprising:

a first plug part movable in said bore;

sealing means carried by said first plug part and frictionally engageable with the wall of said bore;

a second plug part threadedly engageable with said screw-threaded section;

a swivel connection between the plug parts comprising a connecting element extending from said second plug part, said connecting element having a swivel head thereon with a front face distal, and a rear face proximal, to said second plug part, said front face of said swivel head being rotatably engageable with an abutting surface on said first plug part;

a retainer element supported by said first plug part for rotably engaging the rear face of said head;

the frictional drag on either the front face of said swivel head by said abutting surface or the rear face thereof by said retainer element being less than the frictional drag on said sealing means by said wall of said bore, whereby rotation of said second plug part will not cause rotation of said first plug part; and a tool receiving formation on said second plug part for enabling rotation of said second plug part within said bore in threaded engagement with said screw-threaded section.

* * * * *